US009901191B1

(12) United States Patent
Schmidt

(10) Patent No.: US 9,901,191 B1
(45) Date of Patent: Feb. 27, 2018

(54) CONSUMER PRODUCT ADJUSTABLE MERCHANDISING TRAY

(71) Applicant: Aisle Logic, Inc., Saukville, WI (US)

(72) Inventor: David G. Schmidt, Cedarburg, WI (US)

(73) Assignee: Aisle Logic, Inc., Saukville, WI (US)

( * ) Notice: Subject to any disclaimer, the term of this patent is extended or adjusted under 35 U.S.C. 154(b) by 0 days.

(21) Appl. No.: 15/249,632

(22) Filed: Aug. 29, 2016

(51) Int. Cl.
*A47F 1/12* (2006.01)
*A47F 5/00* (2006.01)
*A47F 1/04* (2006.01)

(52) U.S. Cl.
CPC ..... *A47F 5/0025* (2013.01); *A47F 1/12* (2013.01); *A47F 1/123* (2013.01); *A47F 1/125* (2013.01); *A47F 1/126* (2013.01); *A47F 5/005* (2013.01); *A47F 5/0093* (2013.01)

(58) Field of Classification Search
CPC .... A47F 1/04; A47F 1/12; A47F 1/125; A47F 1/126; A47F 5/005; A47F 5/0093; A47F 5/0025
See application file for complete search history.

(56) References Cited

U.S. PATENT DOCUMENTS 870,993 A * 11/1907 Richardson ..... A47B 61/04 211/184
6,357,606 B1 * 3/2002 Henry ..... A47F 1/126 211/184
7,124,898 B2 * 10/2006 Richter ..... A47F 1/126 211/184
7,631,771 B2 * 12/2009 Nagel ..... A47F 3/0486 211/59.3
7,681,743 B2 * 3/2010 Hanretty ..... A47F 1/04 211/59.2
8,016,139 B2 * 9/2011 Hanners ..... A47F 5/005 211/184
9,198,527 B2 * 12/2015 Goehring ..... A47F 1/12
2002/0170866 A1 * 11/2002 Johnson ..... A47F 1/126 211/59.3
2004/0079715 A1 4/2004 Richter et al.
2005/0127014 A1 * 6/2005 Richter ..... A47F 1/126 211/59.2
2005/0133471 A1 * 6/2005 Squitieri ..... A47F 1/12 211/59.2
2006/0196840 A1 * 9/2006 Jay ..... A47F 1/12 211/59.2

(Continued)

*Primary Examiner* — Daniel J Troy
*Assistant Examiner* — Kimberley S Wright
(74) *Attorney, Agent, or Firm* — Andrus Intellectual Property Law, LLP

(57) ABSTRACT

A merchandising tray used for displaying product containers includes a base defining a support surface, and a single side wall divider connected to the base. The single side wall divider has a vertical wall provided with a rearward end and a forward end, a first retaining structure formed between the rearward end and the forward end, and the forward end being formed with a supporting wall having a second retaining structure. The merchandising tray is adapted to be suspended upon a group of like adjacently disposed merchandising trays such that the first retaining structure is engaged with the second retaining structure. A merchandising tray arrangement and methods of using the merchandising trays are also disclosed.

18 Claims, 13 Drawing Sheets

(56) References Cited

U.S. PATENT DOCUMENTS

| | | | | |
|---|---|---|---|---|
| 2007/0075028 | A1* | 4/2007 | Nagel | A47F 3/0486 211/59.2 |
| 2007/0119799 | A1* | 5/2007 | Hanretty | A47F 1/04 211/59.2 |
| 2010/0252519 | A1* | 10/2010 | Hanners | A47F 5/005 211/184 |
| 2011/0147323 | A1* | 6/2011 | Sainato | A47F 1/12 211/59.2 |
| 2012/0204458 | A1* | 8/2012 | Goehring | A47F 1/12 40/642.02 |
| 2013/0026117 | A1* | 1/2013 | Hardy | A47F 1/126 211/59.3 |
| 2014/0124463 | A1* | 5/2014 | Goehring | A47F 1/12 211/49.1 |
| 2016/0088955 | A1* | 3/2016 | Lilja | A47F 1/12 211/59.2 |
| 2016/0150894 | A1* | 6/2016 | Howard | A47F 1/126 211/59.3 |
| 2017/0020302 | A1* | 1/2017 | Goehring | A47F 1/125 |

* cited by examiner 10
58
78
12
62

10
58
80
12

78
36
62
70
14
10
58
82
12
62
80
36
70
14
10
84
82
58
62
12

36
70
14
70

84
36
14

CONSUMER PRODUCT ADJUSTABLE MERCHANDISING TRAY

FIELD OF THE INVENTION

The present disclosure is generally related to mass merchandising of packaged food products, such as yogurt products, which are typically arranged in refrigerated display cases. More particularly, the present disclosure pertains to merchandising trays used in displaying containers for these food products within display cases.

BACKGROUND OF THE INVENTION

Yogurt products are conventionally marketed in product containers having various sizes and shapes which have different contours and heights. Yogurt products are frequently displayed in product containers which are aligned in rows, and may be stacked vertically one upon the other in a refrigerated display case.

In an effort to provide and maintain an orderly, neat and attractive appearing display, a great amount of manpower is spent in loading and restocking/reorganizing display cases. Attempts to maintain food products, such as yogurt, in a desired orderly fashion while allowing easy removal by consumers and efficient restocking/reorganizing by storekeepers have been made by using various types of merchandising trays. One known merchandising tray requires two L-shaped tray sections having vertical side wall portions integrally joined by horizontal bottom portions which are relatively adjustable to provide for various widths and accommodation of differently sized product containers. Such merchandising trays are designed to be removed from and reloaded away from the display case.

It is desirable to provide an improved merchandising tray having a more economically and versatile single side wall divider and an adjustable base which accommodate a variety of product container sizes, and, upon removal from a group of like merchandising trays on a display shelf, is conveniently supported and retained for loading or reloading immediately adjacent the display case upon a selected number of the merchandising trays positioned on the display shelf.

SUMMARY OF THE INVENTION

The present disclosure relates to a merchandising tray used for displaying product containers. The merchandising tray includes a base defining a support surface adapted to support product containers thereon. A single side wall divider is connected to the base. The single side wall divider has a vertical wall having a rearward end and a forward end, a first retaining structure formed between the rearward end and the forward end and the forward end being formed with a supporting wall having a second retaining structure. The merchandising tray is adapted to be suspended upon a group of like adjacently disposed merchandising trays such that the first retaining structure is engaged with the second retaining structure.

The present disclosure further relates to a merchandising tray arrangement for displaying product containers and including a plurality of adjacently disposed merchandising trays supported upon a shelf. Each of the merchandising trays is associated with a least one row of product containers. Each merchandising tray includes a base positioned on the shelf and configured for supporting the product containers thereon. A single side wall divider is fixedly connected to and extends upward from the base. The side wall divider is positioned adjacent the product containers configured for support on the base. The side wall divider has a vertical wall having a rearward end and a forward end, a retaining aperture structure formed between the rearward end and the forward end, and the forward end being formed with a supporting wall having a retainer structure thereon. Upon removal of at least one of the merchandising trays from the shelf, the one removed merchandising tray is suspended with the base facing outwardly along a front end of the shelf such that the retaining aperture structure of the at least one merchandising tray is engaged with the retainer structure of a group of the adjacently disposed merchandising trays to enable servicing of the at least one merchandising tray.

The present disclosure also contemplates a method of stocking and restocking product containers on a display structure having a merchandising tray arrangement formed of a plurality of adjacently disposed merchandising trays associated with product containers and supported upon a shelf. The method includes the a steps of: a) providing each of the merchandising trays with a base supported on the shelf and supporting the product containers, a single side wall divider fixedly connected to the base and positioned adjacent the product containers supported on the base, the side wall divider having a vertical side wall having a rearward end and a forward end, a slot structure formed between the rearward end and the forward end, and the forward end being formed with a supporting wall having a hook structure thereon; b) removing at least one merchandising tray from the merchandising tray arrangement supported on the shelf; c) supporting the at least one merchandising tray along the front of the shelf such that the slot structure of the at least one merchandising tray is engaged with the hook structure of a group of selected merchandising trays supported on the shelf; d) loading product containers on the at least one merchandising tray suspended from the group of merchandising trays supported on the shelf; and e) replacing the at least one loaded merchandising tray upon the shelf.

The present disclosure additionally contemplates a method of maintaining a display structure having a merchandising tray arrangement formed of a plurality of adjacently disposed merchandising trays associated with product containers, and supported upon the shelf. The method includes the steps of a) moving at least one merchandising tray of the merchandising tray arrangement relative to the shelf; and b) supporting the at least one merchandising tray on the display structure at a front end of the shelf to enable servicing of the one merchandising tray.

BRIEF DESCRIPTION OF THE DRAWINGS

The drawings illustrate the best mode presently contemplated of carrying out the invention. In the drawings.

DETAILED DESCRIPTION

Figure 1:
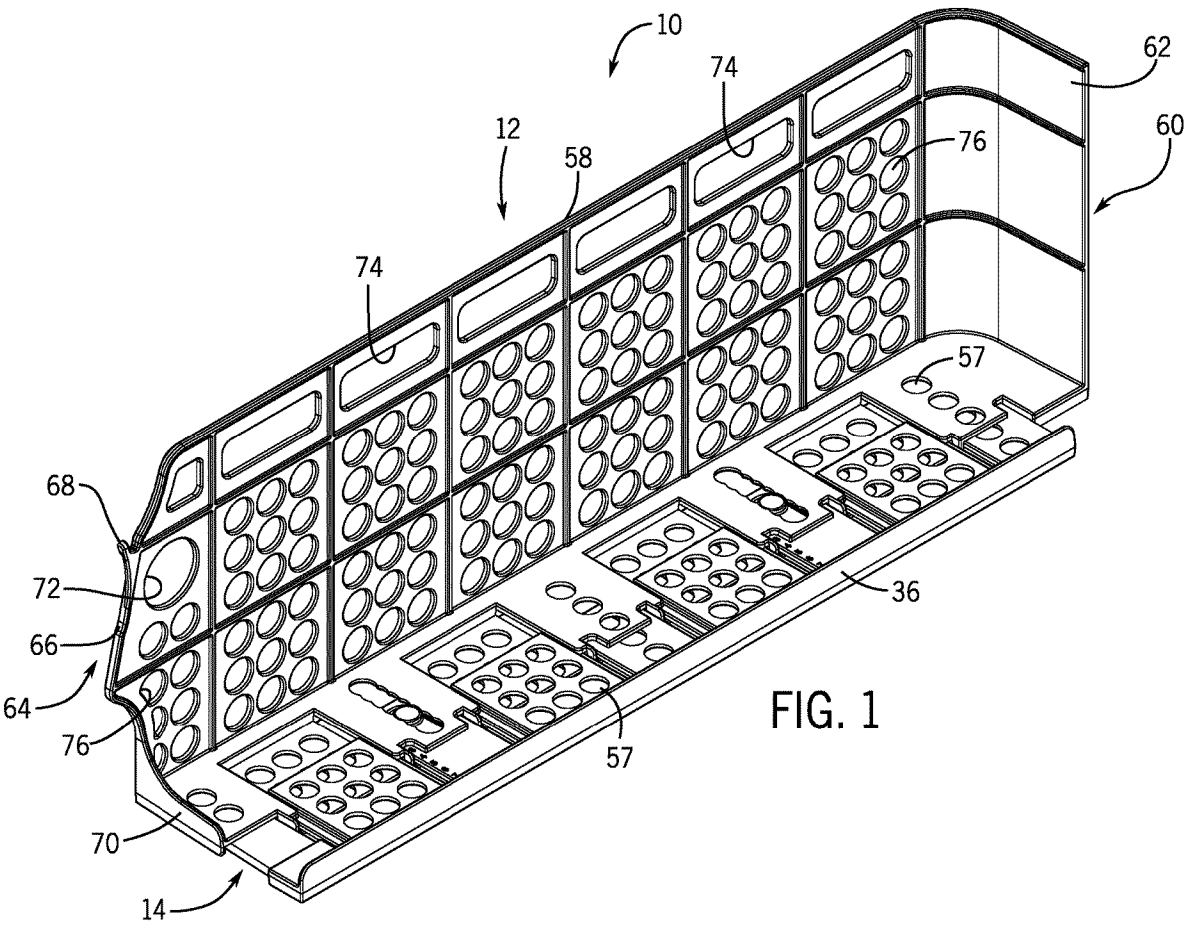
FIG. 1 is a front perspective view of a merchandising tray in accordance with the present disclosure.
Figure 2:
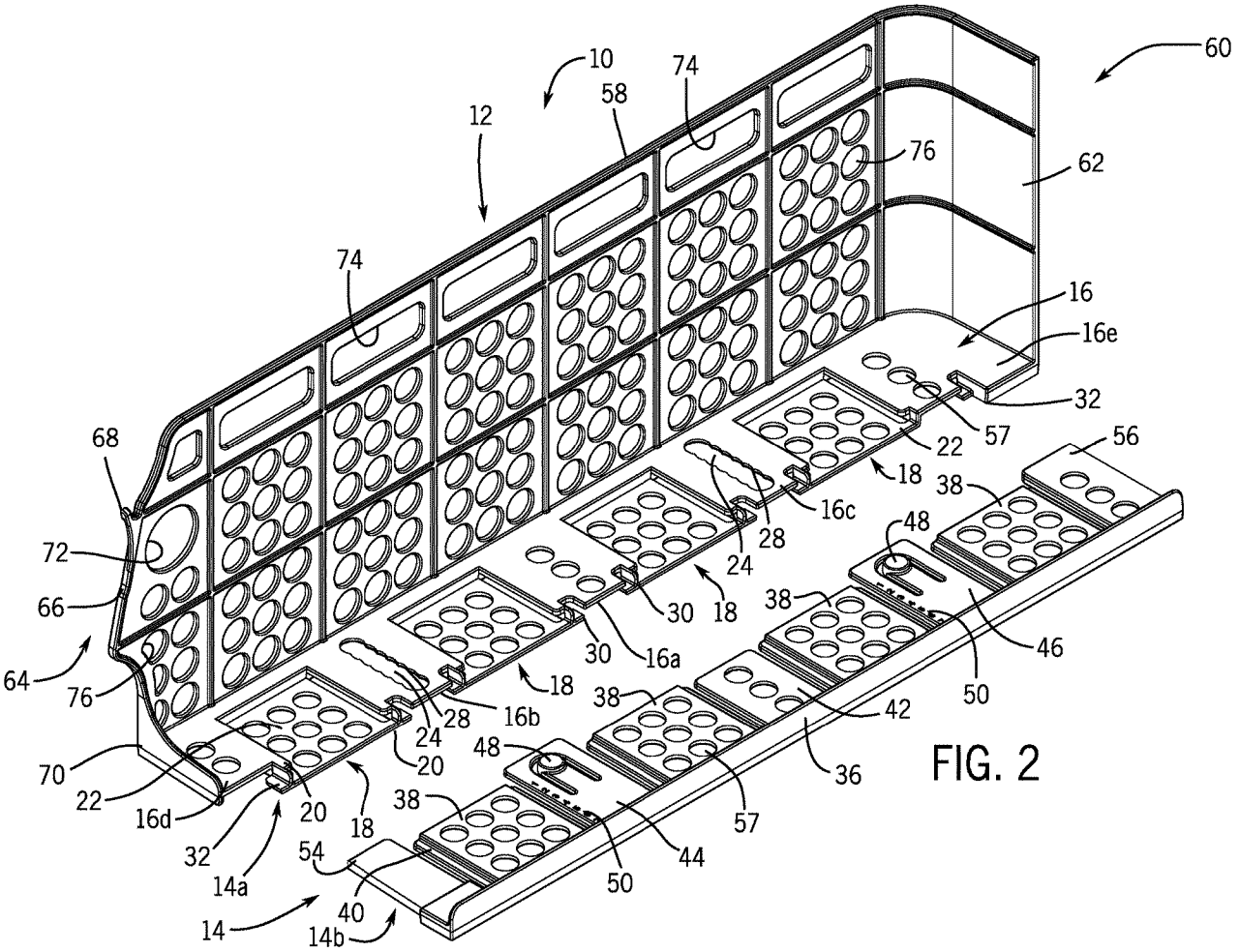
FIG. 2 is an exploded view of the merchandising tray shown in FIG. 1.

Referring now to FIGS. 1 and 2 of the drawings, there-shown is a merchandising tray 10 according to the present disclosure comprised of a single side wall divider 12 and an adjustable base 14 which are both preferably formed of a relatively rigid, yet light-weight, molded plastic construction. The adjustable base 14 includes a fixed base portion 14*a* and a separate movable base portion 14*b*. The fixed base portion 14*a* is integrally joined to the bottom of side wall divider 12, and the movable base portion 14*b* is slidably received and retained relative to the fixed base portion 14*a*. It is contemplated that the merchandising tray 10 may be produced in a variety of lengths and heights and, as will be described below, is configured with width adjustment via the adjustable base 14 to accommodate a variety of differently sized and shaped product containers.

Pursuant to one feature of the present disclosure, the fixed base portion 14*a* and the movable base portion 14*b* have cooperating structure to enable a width adjustment of the merchandising tray 10. As seen in FIGS. 1-9C, the fixed base portion 14*a* has a planar surface 16 constructed with four depending pockets 18, each of which is formed with side tracks 20 and a bottom surface 22. The planar surface 16 includes an apertured central portion 16*a* and coplanar spaced apart lateral portions 16*b*, 16*c* which are both formed with slots 24 having rounded ends 26, 27 and scalloped side portions 28. Each of the planar portions 16*a*, 16*b*, 16*c* provide underlying side tracks 30. The planar surface 16 further includes a forward end portion 16*d* and a rearward end portion 16*e* which define underlying guides 32. The fixed base portion 14*a* is formed along a length of the merchandising tray 10 with the bottom surfaces 22, the central and lateral portions 16*a*, 16*b*, 16*c* and the end portions 16*d*, 16*e* continuously joined together.

The movable base portion 14*b* includes a planar surface 34 (FIGS. 3 and 4) which is integrally connected to an upstanding outer lip 36, and which is integrally formed with four tabs 38 sized and shaped to be slidably received over the bottom surfaces 22 and into the pockets 18 of the fixed base portion 14*a*. To facilitate the sliding cooperation between the tabs 38 and the pockets 18, each of the tabs 38 is provided with opposed side ledges 40 which are received in the side tracks 20 on the fixed base portion 14*a*. The movable base portion 14*b* is also integrally formed with an apertured central tongue 42 and spaced apart lateral tongues 44, 46, each of the latter having a length slightly greater than a length of the central tongue 42. Each of the central and lateral tongues 42, 44, 46 has side edges designed to be slidably engaged with the side tracks 30 formed beneath the central and lateral portions 16*a*, 16*b*, 16*c* on the fixed base portion 14*a*.

Figure 3:
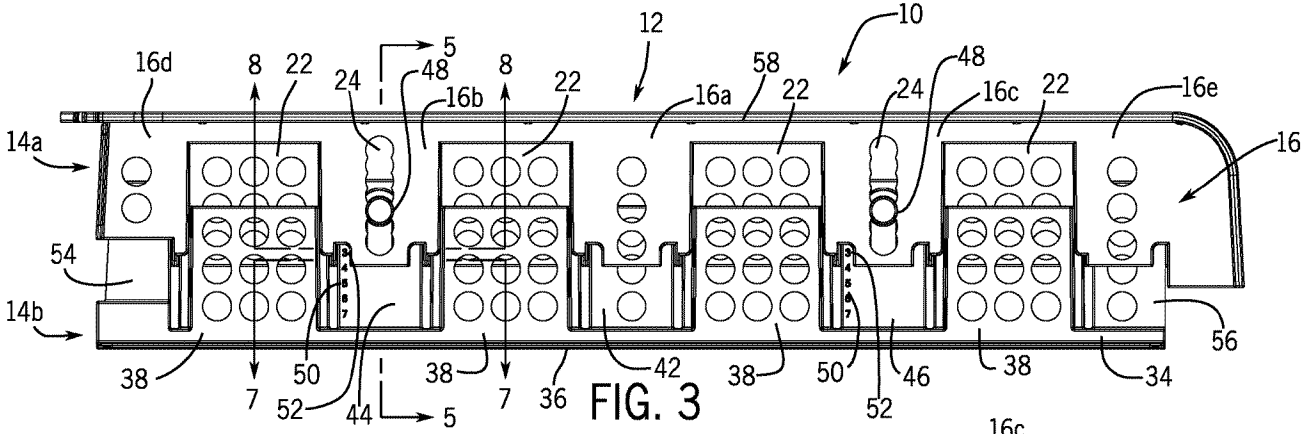
FIG. 3 is a top view of the merchandising tray shown in FIG. 1.
Figure 4:
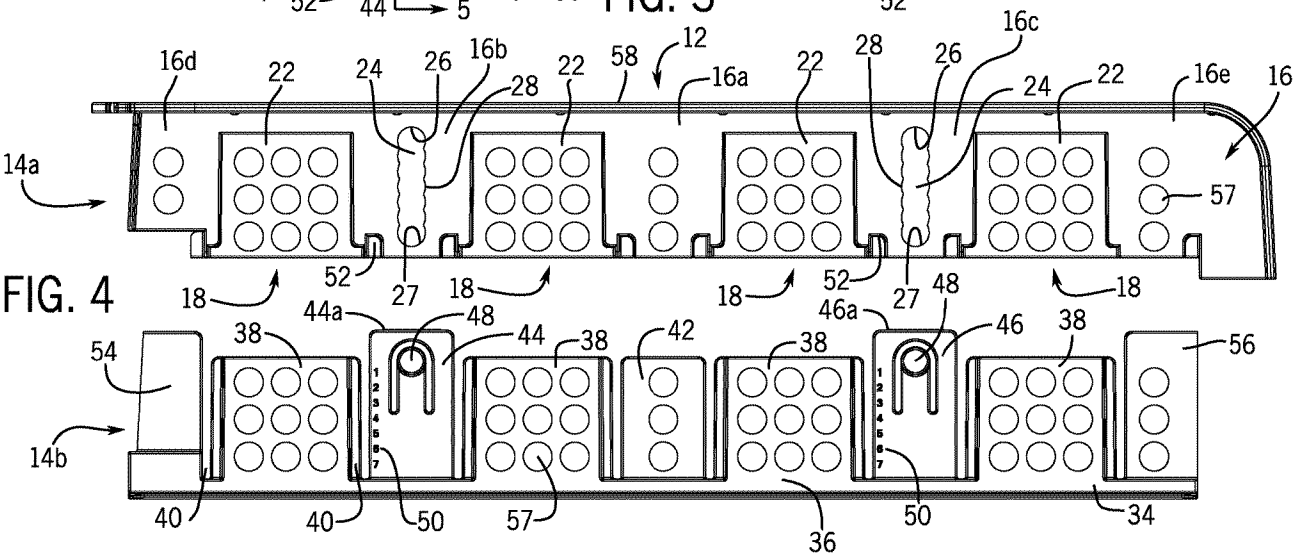
FIG. 4 is a top view of the merchandising tray shown in FIG. 2.
Figure 6:
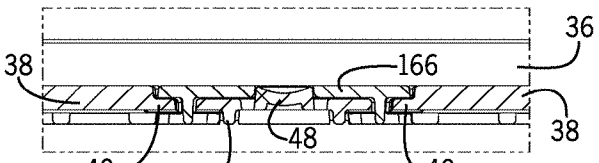
FIG. 6 is a sectional view of the merchandising tray taken on line 6-6 of FIG. 5.
Figure 7:
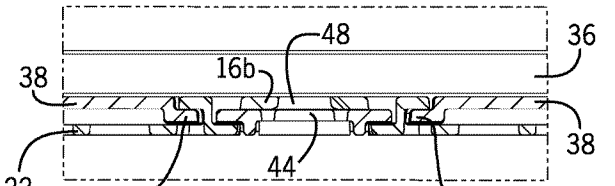
FIG. 7 is a sectional view of the merchandising tray taken on line 7-7 of FIG. 5.
Figure 8:
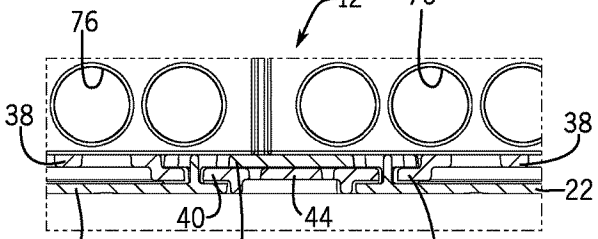
FIG. 8 is a sectional view of the merchandising tray taken on line 8-8 of FIG. 5.
Figure 5:
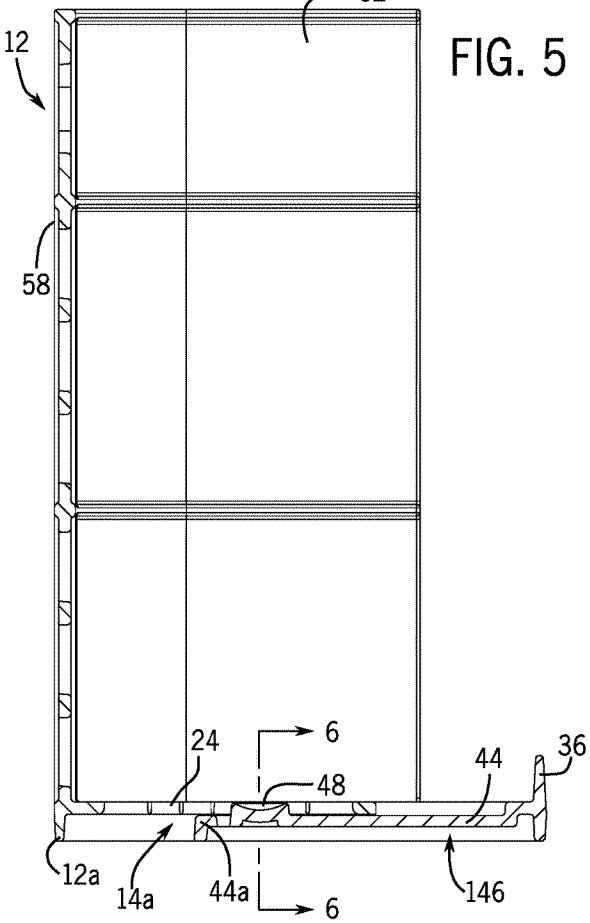
FIG. 5 is a sectional view of the merchandising tray taken on line 5-5 of FIG. 3.
Figure 9C:
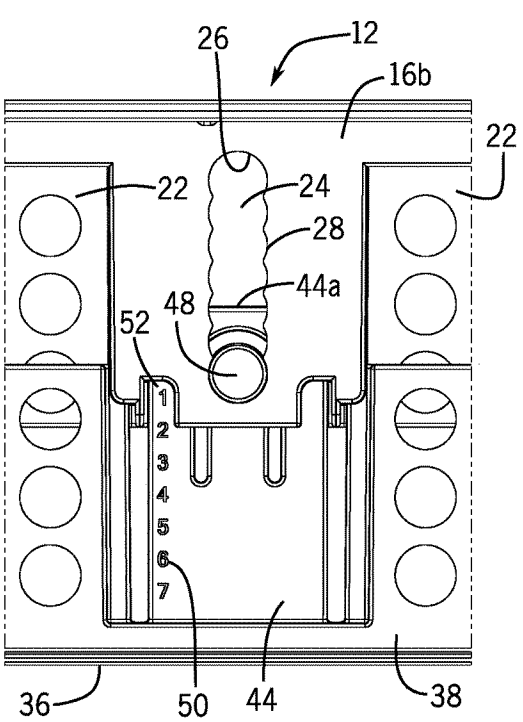
FIG. 9C is a fragmentary view of the merchandising tray in a fully expanded width position.
Figure 9B:
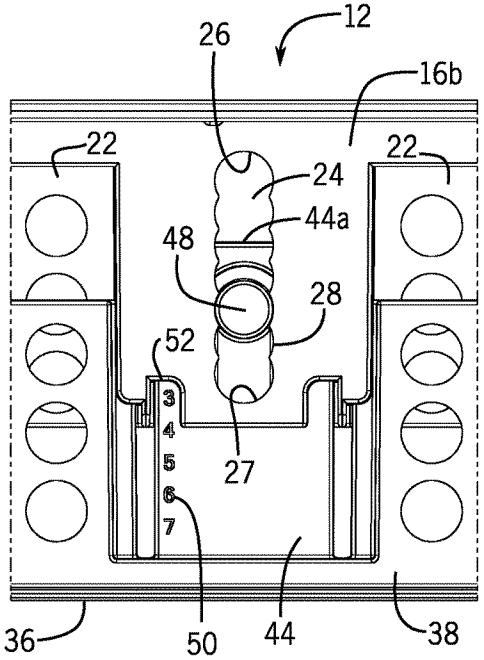
FIG. 9B is a fragmentary top view of the merchandising tray shown in FIG. 1 in a partially expanded width position.
Figure 9A:
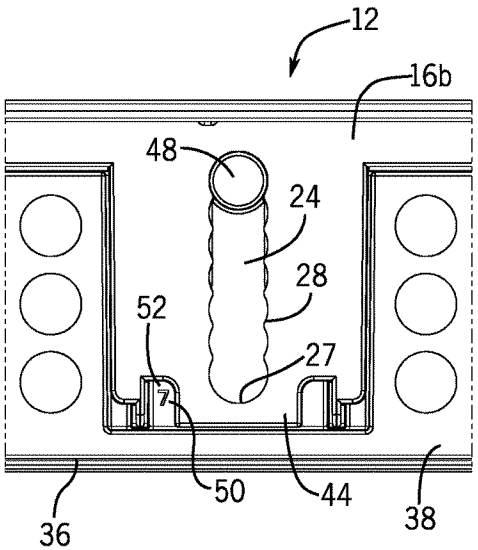
FIG. 9A is a fragmentary top view of the merchandising tray shown in a minimum width position.

The lateral tongues 44, 46 are provided with circular engagement members 48 which are configured to be slidably and frictionally received within the slots 24 formed through the lateral portions 16*b*, 16*c* so as to maintain the fixed and movable base portions 14*a*, 14*b* together during relative sliding movement therebetween. More particularly, as best seen in FIGS. 9A, 9B, 9C, the engagement members 48 are variously engaged with the ends 26, 27 and scalloped portions 28 of the slots 24 to define a number of adjustable width positions for the merchandising tray 10. The top surfaces of the lateral tongues 44, 46 are provided with adjustment setting numbers at 50 for simplifying the width adjustment of the merchandising tray 10. In the examples shown, the tongues 44, 46 are provided with columns of indicia numbers 1-7 which correspond to seven distinct width adjustment settings attained by sliding movement of the movable base portion 14*b* relative to the fixed base portion 14*a*. FIG. 9A exemplifies a minimum width adjustment setting in which the engagement members 48 engage the ends 26 of the slots 24 and the adjustment setting number 7 is visible to a user of the merchandising tray 10 through a small window 52 formed on the lateral portions 16*b*, 16*c*. Although not shown, it should be understood that in the minimum width setting, inner edges 44*a*, 46*a* of the respective tongues 44, 46 abut against a bottom edge 12*a* (FIG. 5) of the side wall divider 12 extending below the fixed portion 14*a*. FIGS. 3 and 9B show an exemplary intermediate width adjustment setting in which the engagement members 48 are frictionally engaged with scalloped portions 28 on the slots 24 that define a detent position which corresponds to an adjustment setting number 3 seen in the windows 52. FIG. 9C illustrates a fully expanded or maximum width adjustment setting in which the engagement members 48 are engaged with the opposite ends 27 of the slots 24 such that the adjustment setting number 1 is visible though the windows 52.

The movable base portion 14*b* further includes a forward projection 54 and a rearward projection 56, each having a length substantially equal to the lengths of the lateral tongues 44, 46. The forward projection 54 is designed to be slidably received beneath forward end portion 16*d* via the guide 32. The rearward projection 56 is configured to be slidably received beneath the rearward end portion 16*e* via the guide 32.

It should be appreciated the that fixed base portion 14*a* and the movable base portion 14*b* have mating elements aligned with each other, and are configured for sliding engagement over or under one another during width adjustment of the merchandising tray 10.

For refrigerated displays, various portions of the fixed base portion 14*a* and the movable base portion 14*b* are provided with numerous openings 57 to accommodate the flow of refrigerated air into the bottom of the merchandising tray 10.

Figure 17:
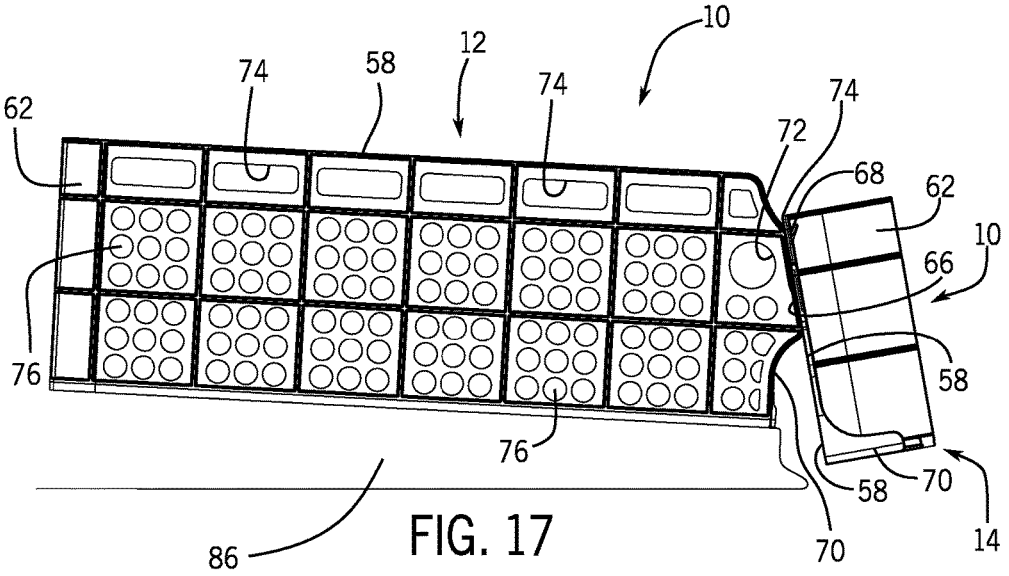
FIG. 17 is a left end view of the display shelf arrangement of FIG. 16.

Pursuant to another feature of the present disclosure, the single side wall divider 12, as best seen in FIGS. 1, 2 and 17, is comprised of a substantially vertical wall 58 having a rearward end 60 integrally formed with a curved backstop 62 which is attached to the rearward end portion 16*e* on fixed base member 14*a*. The backstop 62 serves as a rear stop limit for product containers to be loaded on the merchandising tray 10. The vertical wall 58 has a forward end 64 which is formed with a supporting wall defined by an upper wall portion 66 thereof, and is provided an upwardly and forwardly extending hook or projection 68. That is, the supporting wall 66 extends forwardly and downwardly relative to an upper edge of the vertical wall 58. The upper wall portion 66 is integrally molded with a rearwardly and laterally extending lower wall 70 which is attached to the forward end portion 16*d* on the fixed base portion 14*a*. The lower wall portion 70 functions as a forward stop limit for product containers to be loaded on the merchandising tray 10. The vertical wall 58 is provided adjacent the upper wall portion 66 with a finger engageable circular opening 72, and is provided along an upper portion thereof with an aperture arrangement in the form of a plurality of elongated slots 74 which define hanger openings. In addition, the vertical wall 58 is provided with multiplicity of openings 76 to enable the lateral flow of refrigerated air therethough for cooling product containers to be loaded on merchandising tray 10.

Its is contemplated that the merchandising tray 10 can be provided in various heights and lengths which will accommodate a plurality of product containers which are arranged in a columnar configuration, and may or may not be stacked one on top of the other. The size of the product containers will dictate the width adjustment of the merchandising tray 10.

Figures 10, 11, 12, 13:
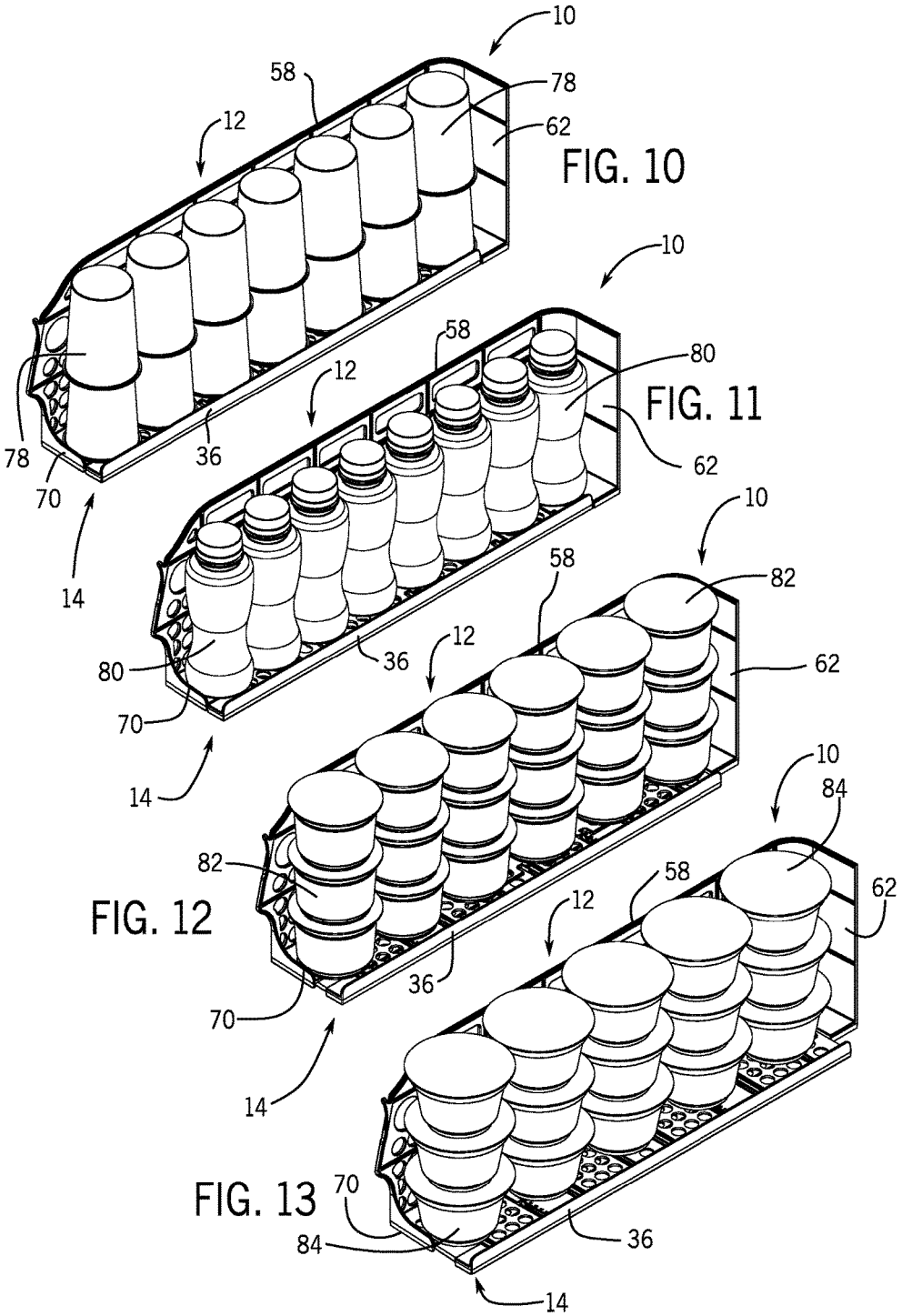
FIG. 10 is a front perspective view of the merchandising tray shown loaded with a first size of product container in a double stacked configuration.
FIG. 11 is a front perspective view of the merchandising tray shown loaded with a second size of product container.
FIG. 12 is a front perspective view of the merchandising tray shown loaded with a third size of product container in a triple stacked configuration.
FIG. 13 is a front perspective view of the merchandising tray shown loaded with a fourth size of product container in a triple stacked configuration.

FIGS. 10-13 illustrate an exemplary loading of the merchandising tray 10 with various product container configurations. FIG. 10 shows the loading of the merchandising tray 10 with a first size of product container 78 in a double stacked arrangement. FIG. 11 exemplifies the loading of merchandising tray 10 with a second size of product container 80. FIG. 12 depicts the loading of the merchandising tray 10 with a third size product container 82 in a triple stacked arrangement. FIG. 13 demonstrates the loading of the merchandising tray 10 with a fourth size product container 84 in a triple stacked arrangement. In each example, the exemplary product containers 78, 80, 82, 84 are supported on a flat surface defined by the adjustable base 14 which is adjusted accordingly for the particular base contours of the product containers. The product containers 78, 80, 82, 84 are confined by the inner surface of the vertical wall 58, the upstanding lip 36 on the base portion 14*b*, and the backstop 62 and the lower wall portion 70 formed on the side wall divider 12.

FIGS. 14-20 illustrate an exemplary use of multiple merchandising trays 10 loaded with stacked product containers 84 in a tight, side-by-side merchandising display arrangement on a display shelf 86 of a refrigerated display structure, such as a display case, in order to achieve optimum density of the product. In this arrangement, the vertical wall 58 functions to separate the individual product container rows of the display arrangement. FIGS. 14-20 depict the ease and efficiency in servicing including cleaning, removing, loading or reloading and replacing the merchandising tray 10 of the present disclosure.

Figure 14:
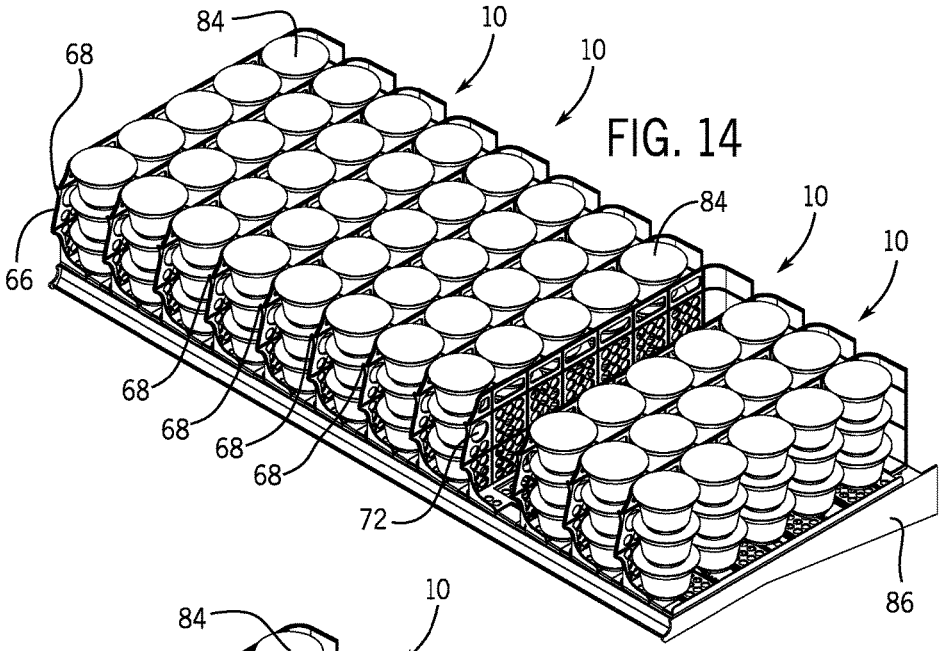
FIG. 14 is a front perspective view of a display shelf arrangement provided with a plurality of closely packed merchandising trays loaded with product containers in a triple stacked configuration and showing one empty merchandising tray positioned thereon.
Figure 15:
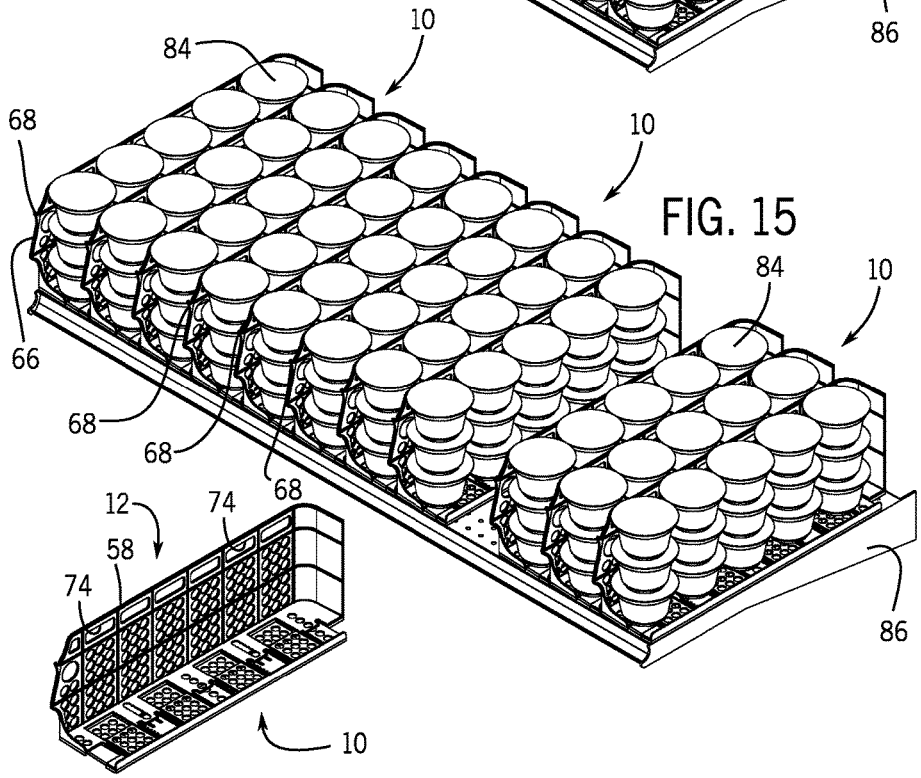
FIG. 15 is a view of the display shelf arrangement of FIG. 14 illustrating the removal of the empty merchandising tray therefrom.
Figure 16:
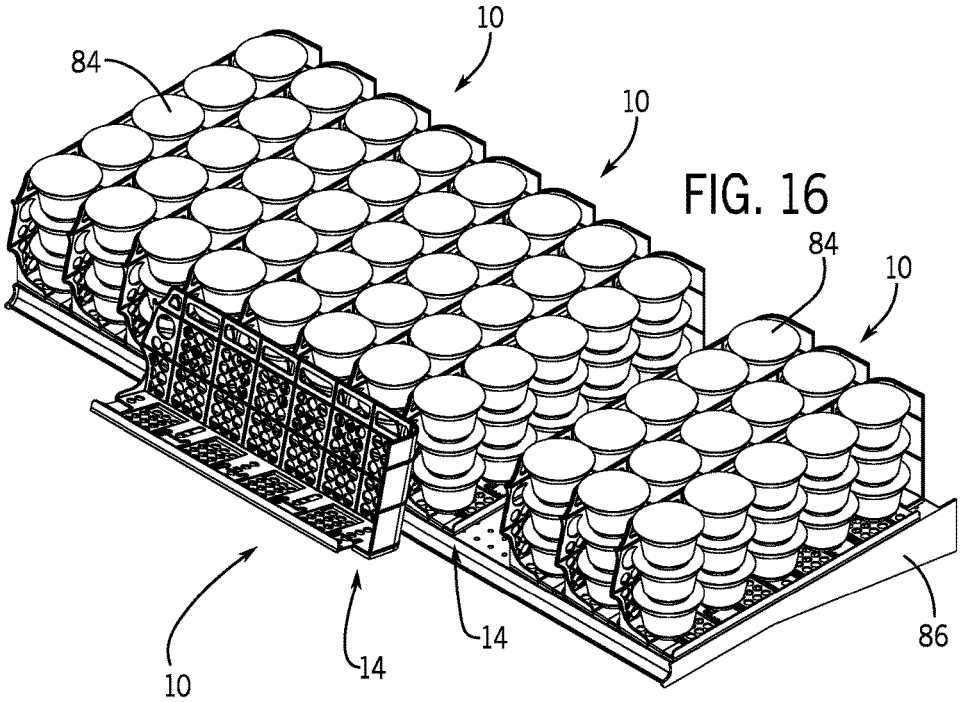
FIG. 16 is a view of the display shelf arrangement of FIG. 15 illustrating retention and support of the removed empty merchandising tray along end portions of a selected group of loaded merchandising trays on the display shelf.

FIG. 14 shows a display structure in which one merchandising tray 10' has been emptied, such as by consumers, and requires reloading or restocking of the product containers 84 by store personnel. The emptied light-weight merchandising tray 10' to be replenished is accessed by inserting one's finger in the opening 72 and extracting the emptied merchandising tray 10' from the display shelf 86 as exemplified in FIG. 15. The merchandising tray 10' is rotated 90 degrees and temporarily retained at the front of the loaded display shelf 86 by engaging the hooks 68 of selected loaded merchandising trays 10 on the display shelf 86 with the upper walls forming the hanger openings 74 formed across the top of the merchandising tray 10' as shown in FIGS. 16 and 17. At the same time, the merchandising tray 10' is suspended and retained from the hooks 68, a back upper portion of the vertical wall 58 is supported along the supporting walls 66 of the selected group of loaded merchandising trays 10 on which the merchandising tray 10' is retained so the merchandising tray 10' is tilted forwardly and outwardly for easy loading. It should be appreciated that, in FIG. 16, although the merchandising trays 10 from which the emptied merchandising tray 10' is suspended are shown filled with product containers 84, it is not necessary that the supporting merchandising trays 10 be completely filled with product containers 84, and, in fact, these supporting merchandising trays 10 may be empty.

The tilting of the suspended merchandising tray 10' as illustrated in FIG. 17 enables store personnel to easily load product containers from one end of an open box of the product containers as shipped from the food product source. While the drawings depict the loading of single product containers, is should be noted that product containers connected together in packs may be loaded into the merchandising tray 10'.

Figure 18:
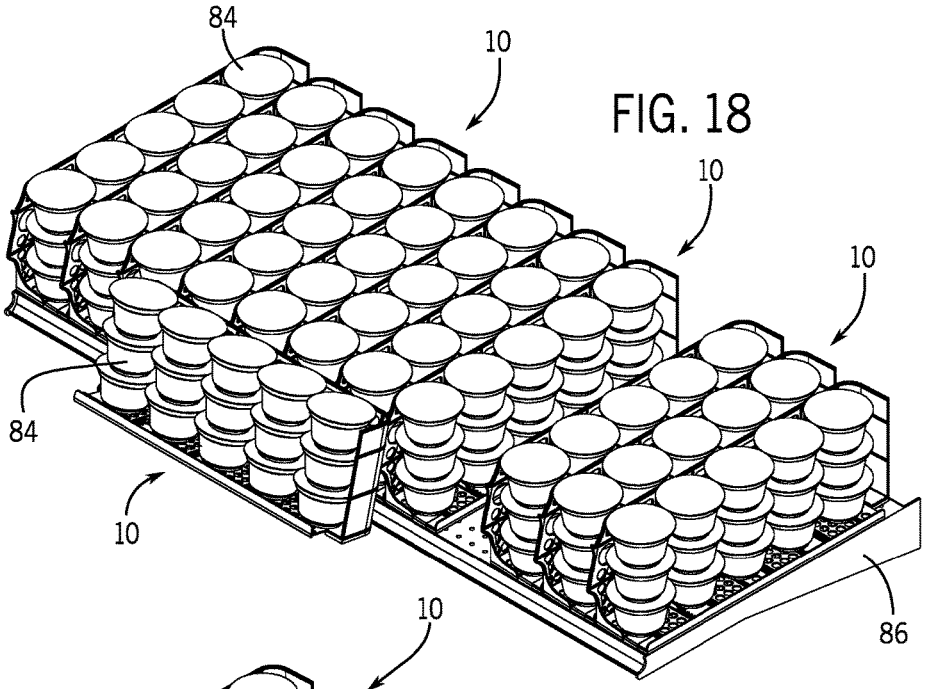
FIG. 18 is a view of the display shelf arrangement similar to FIG. 16 showing refilling of the removed merchandising tray with product containers.
Figure 19:
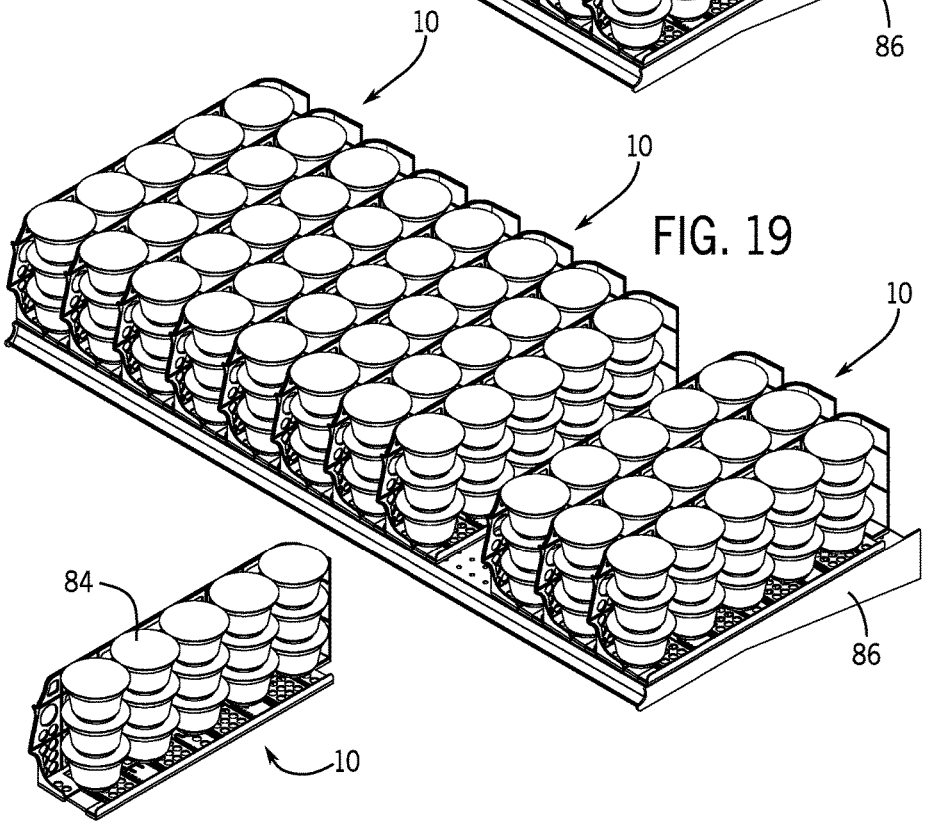
FIG. 19 is a view of the display shelf arrangement similar to FIG. 15 showing removal of the refilled merchandising tray from the end portions of the merchandising trays and positioning of the merchandising tray prior to replacement on the display shelf.
Figure 20:
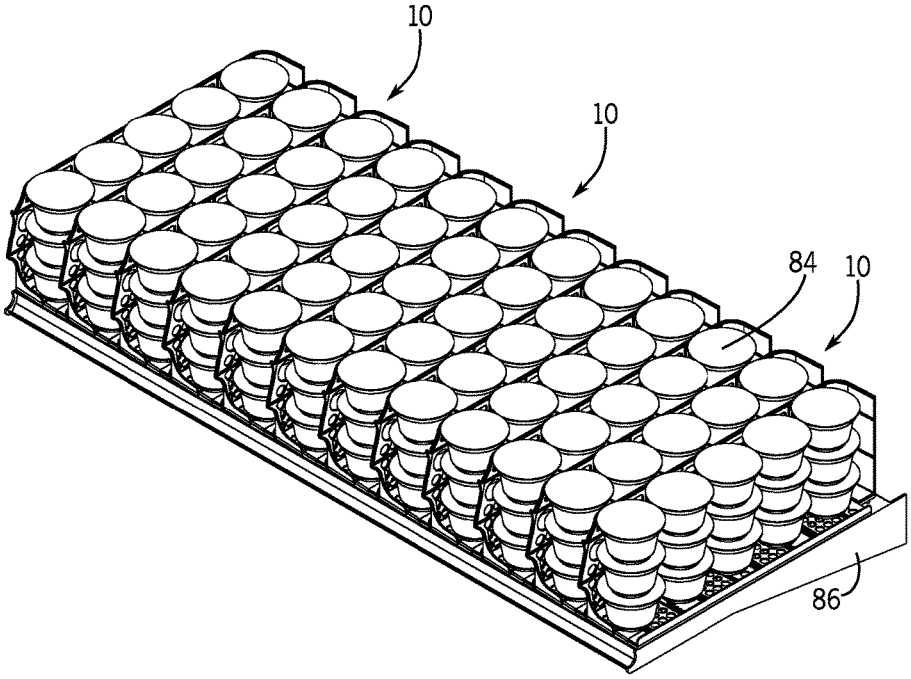
FIG. 20 is a view of the display shelf arrangement showing the completed replacement of the refilled merchandising tray.

Now, the merchandising tray 10' is easily loaded or replenished with product containers 84 as shown in FIG. 18. It should be appreciated that the single side wall divider 12 provides unobstructed access for loading the merchandising tray 10'. The merchandising tray 10' now loaded or restocked with product containers 84 is lifted from the hooks 68 and rotated 90 degrees as shown in FIG. 19, after which the loaded merchandising tray 10' is replaced in its original position on the display shelf 86 which is fully stacked with products as seen in FIG. 20.

Although the drawings illustrate a single merchandising tray 10' suspended adjacent the front end of the display shelf 86, the present disclosure contemplates that multiple merchandising trays 10' may be similarly positioned for loading/replenishing product containers depending on the size of the merchandising tray 10 and the number of supporting merchandising trays 10 placed on the display shelf 86.

It should also be understood that the present disclosure contemplates that the display structure shown in FIGS. 14-20 may be comprised of a tray arrangement of empty merchandising trays 10 positioned upon the display shelf 86. In this case, each empty merchandising tray 10 is removed from the shelf 86 and suspended adjacent the front of the display structure, loaded with product containers 84 and then replaced on the display shelf 86 thus facilitating an efficient method of loading product containers 84 on the display structure.

Figure 21:
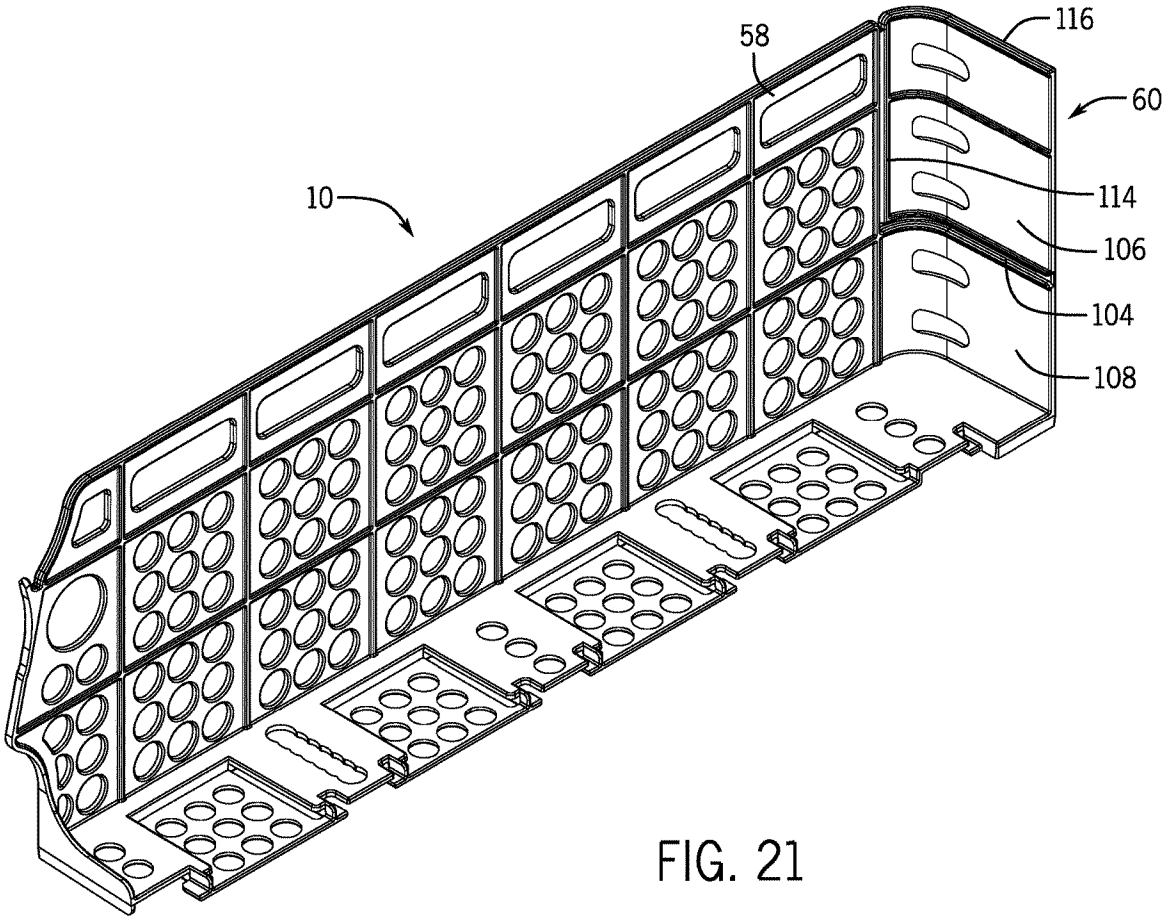
FIG. 21 is a front perspective view of a second embodiment of a merchandising tray in accordance with the present disclosure.
Figure 22:
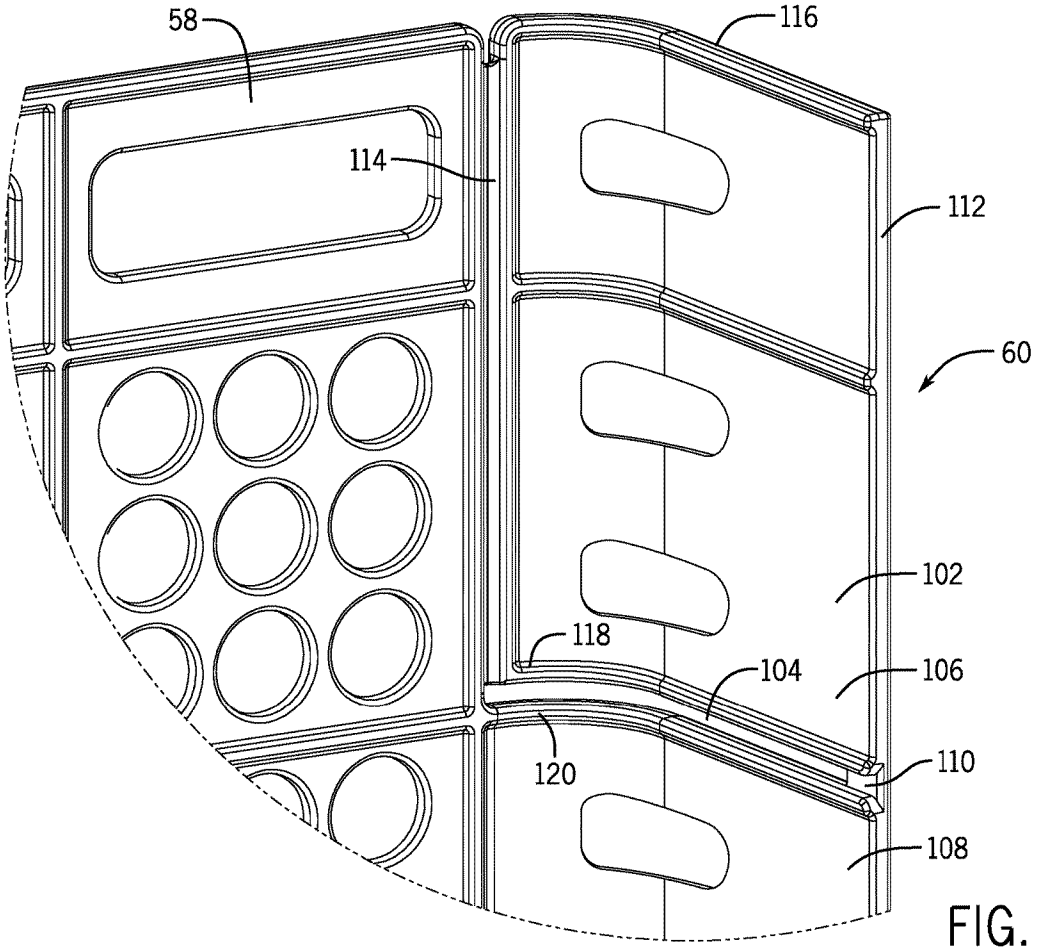
FIG. 22 is a magnified view of the curved backstop in accordance with the second embodiment.
Figure 23:
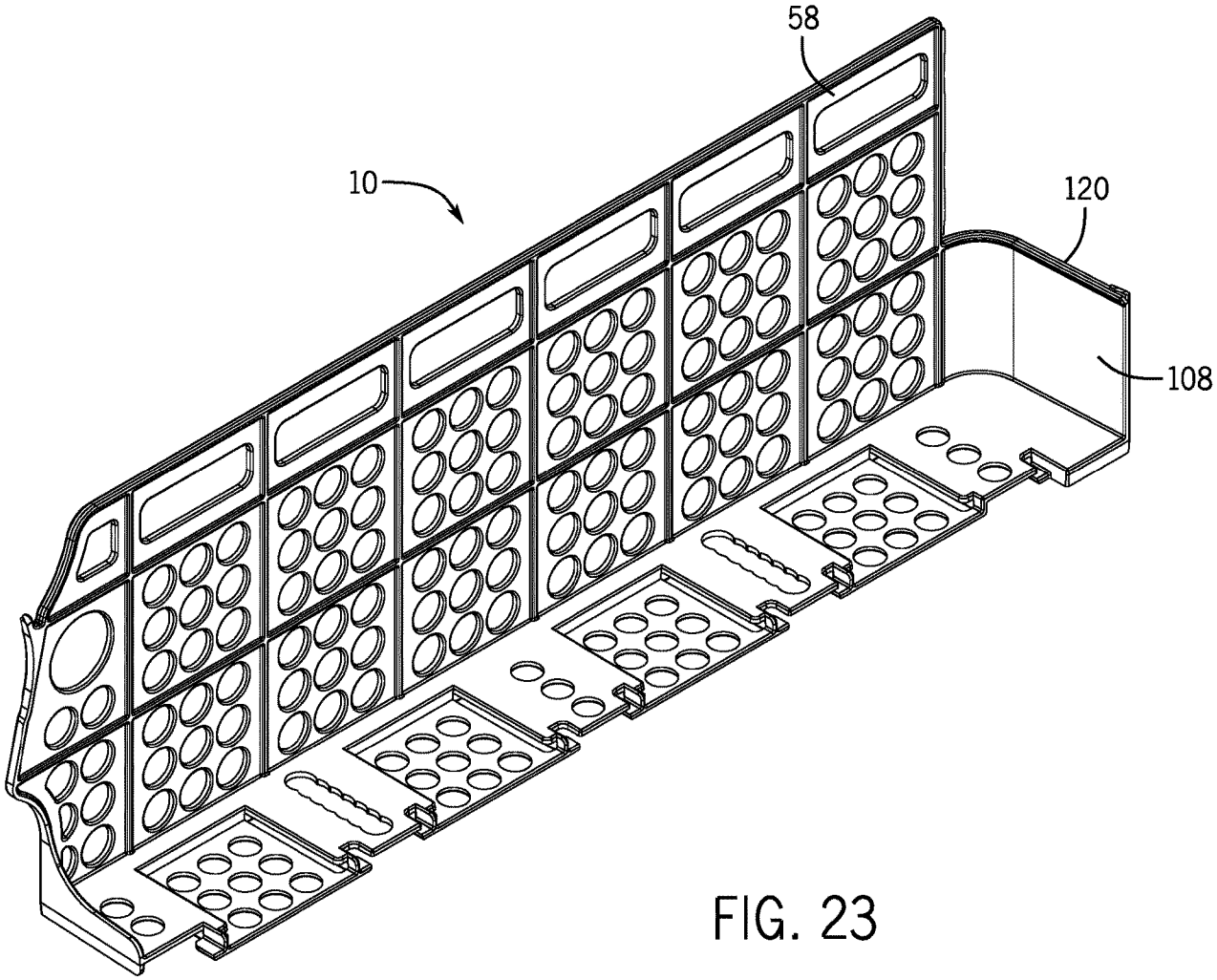
FIG. 23 is a front perspective view showing the removal of a portion of the curved backstop.

FIGS. 21-23 illustrate a second embodiment of the merchandising tray 10. Most of the features of the second embodiment are the same as the first embodiment previously described. In the second embodiment shown in FIGS. 21-23, the rearward end 60 includes features that allow the height of the rearward end 60 to be selectively modified. As illustrated in FIG. 22, the rearward end 60 includes a modified curved backstop 102. The modified curved backstop includes a removed area 104 positioned between a top wall portion 106 and a bottom wall portion 108. A connecting portion 110 connects the top wall portion 106 to the bottom wall portion 108 along the outer edge 112. The top wall portion 106 is joined to the vertical wall 58 at a side opposite the outer edge 112 along a vertical break line 114. The vertical break line 114 is a weakened portion of the molded merchandising tray 10 that extends from the top edge 116 to the bottom edge 118. As illustrated in FIG. 22, the bottom edge 118 is spaced above the top edge 120 by the width of the removed area 104.

In certain situations, such as when the merchandising tray 10 is used on a shelf in a location aligned with a support bracket for the shelf, it may be desirable to remove the top wall portion 106. FIG. 23 illustrates a condition in which the top wall portion 106 has been removed from the merchandising tray 10. In this removed condition, the top edge 120 of the bottom wall portion 108 allows a shelf bracket to extend into the merchandising tray.

In order to remove the top wall portion 106, a user first snips the connecting portion 110 shown in FIG. 22. Once the connecting portion 110 has been removed or broken, the user can flex the top wall portion 106 repeatedly, causing the vertical break line 114 to snap along the vertical score. The top wall portion 106 can then be removed to create the modified merchandising tray 10 shown in FIG. 23. If the merchandising tray 10 is not in a positioned in a location that needs a reduced height rearward end 60, the connecting portion 110 and the vertical break line 114 are strong enough to provide the required stability for the top wall portion 106.

The merchandising tray of the present disclosure provides unique and significant advantages. By providing a merchandising tray constructed of a single side wall divider and an adjustable base, the manufacturing cost is greatly reduced. In addition, the support and retention arrangement provided by the merchandising tray results in a highly efficient, labor reduced and more economical servicing of a display structure as product containers are conveniently loaded and replenished immediately adjacent the display shelf supporting the remainder of the loaded merchandising trays.

Various alternatives and embodiments are contemplated as being within the scope of the following claims particularly pointing out and distinctively claiming the subject matter regarded as the invention.

What is claimed is:

1. A merchandising tray for use with a group of adjacently disposed merchandising trays used for displaying product containers comprising:

a base defining a horizontal support surface having a first side edge and a second side edge and configured to support product containers thereon; and a single side wall divider connected to the base, wherein the single side wall divider has a vertical wall connected to the first side edge and having an upper edge, a rearward end and a forward end, a plurality of apertures formed in the vertical wall between the rearward end and the forward end, and the forward end being formed with a supporting wall extending downwardly from the upper edge, the supporting wall having at least one projection extending upwardly and forwardly from the supporting wall at the forward end of the supporting wall, the merchandising tray being configured to be suspended upon the group of like adjacently disposed merchandising trays such that one or more of the plurality of apertures are engaged by the projections of the group of adjacently disposed merchandising trays such that the second side edge of the base faces outwardly away from the shelf.

2. The merchandising tray of claim 1, wherein the base is configured to provide an adjustable width for the support surface.

3. The merchandising tray of claim 1, wherein the base includes a first base portion fixed to the vertical wall, and a second base portion slidably connected to the first base portion.

4. The merchandising tray of claim 1, wherein the plurality of apertures are formed in an upper portion of the vertical wall.

5. The merchandising tray of claim 1, wherein the supporting wall slopes forwardly and downwardly relative to the upper edge of the vertical wall.

6. The merchandising tray of claim 3, wherein the forward end of the vertical wall includes a lower wall portion attached to the first base portion.

7. The merchandising tray of claim 3, wherein the rearward end of the vertical wall includes a curved backstop connected to the first base portion.

8. The merchandising tray of claim 7, wherein the curved backstop includes a removable top wall portion connected to a bottom wall portion.

9. A merchandising tray arrangement for displaying product containers on a horizontal shelf comprising:

a plurality of adjacently disposed merchandising trays supported on the shelf, each of the merchandising trays being associated with at least one row of product containers, wherein each merchandising tray includes:

a base positioned on the shelf and having a first side edge and a second side edge and configured for supporting the product containers; and a single side wall divider fixedly connected to and extending upward from the base, the side wall divider being positioned adjacent the product containers configured for support on the base, wherein the side wall divider has a vertical wall connected to the first side edge and having an upper edge, a rearward end and forward end, at least a pair of retaining apertures formed between the rearward end and the forward end, and the forward end being formed with a supporting wall extending downwardly from the upper edge, the supporting wall having a projection extending upwardly and forwardly therefrom, and wherein, upon removal of at least one of the merchandising trays from the shelf, the one removed merchandising tray is suspended with the second side edge of the base facing outwardly and away from the shelf, such that the retaining apertures of the at least one merchandising tray is engaged with the projections formed on a group of the adjacently disposed merchandising trays to enable servicing of the at least one merchandising tray.

10. The merchandising tray arrangement of claim 9, wherein the plurality of retaining apertures are spaced along an upper portion of the vertical wall.

11. The merchandising tray arrangement of claim 9, wherein the supporting wall is configured to suspend the at least one merchandising tray at a tilted orientation extending away from the shelf.

12. The merchandising tray arrangement of claim 9, wherein the supporting wall is oriented forwardly and downwardly relative to the upper edge of the vertical wall.

13. The merchandising tray arrangement of claim 9, wherein the base includes a first base portion fixed to the vertical wall, and a second base portion slidably connected to the first base portion and configured to adjust the width of each merchandising tray.

14. The merchandising tray arrangement of claim 13, wherein the first base portion includes at least one slot formed with a periphery defining a number of detent positions, and the second base portion includes an engagement member engageable with the slot periphery and configured to establish a number of adjustable width positions.

15. The merchandising tray arrangement of claim 13, wherein the first base portion and the second base portion have cooperating elements which are aligned with one another and are configured for sliding engagement over and under one another during width adjustment of each merchandising tray.

16. A method of stocking and restocking product containers on a display structure having a merchandising tray arrangement formed of a plurality of adjacently disposed merchandising trays associated with product containers and supported upon a shelf, the method comprising the steps of:

a) providing each of the merchandising trays with a base supported on the shelf and supporting the product containers, and a single side wall divider fixedly connected to a first side edge of the base and positioned adjacent the product containers supported on the base, the side wall divider including a vertical wall having an upper edge, a rearward end and a forward end, a slot structure formed between the rearward end and the forward end, and the forward end being formed with a supporting wall extending downwardly from the upper edge and having a hook structure extending upwardly and forwardly therefrom;

b) removing at least one merchandising tray from the merchandising tray arrangement supported on the shelf;

c) supporting the at least one merchandising tray along the front of the shelf such that a second side edge of the base faces outwardly and away from the shelf and the slot structure of the at least one merchandising tray is engaged with the hook structure of a group of selected merchandising trays supported on the shelf;

d) loading product containers on the at least one merchandising tray suspended from the group of merchandising trays supported on the shelf; and e) replacing the at least one loaded merchandising tray upon the shelf.

17. The method of claim 16, wherein the supporting wall is oriented forwardly and downwardly relative to the upper edge of the vertical wall.

18. A merchandising tray arrangement for displaying product containers on a horizontal shelf comprising:

a plurality of adjacently disposed merchandising trays supported on the shelf, each of the merchandising trays being associated with at least one row of product containers, wherein each of the merchandising trays comprises:

a base positioned on the shelf and configured for supporting the product containers;

a single side wall divider fixedly connected to a first side edge of the base and positioned adjacent to the product containers when the product containers are supported on the base, the side wall divider including an upper edge and a vertical wall having a rearward end and a forward end;

a plurality of slots formed in the vertical wall between the rearward end and the forward end;

a supporting wall formed on the forward end of the vertical wall, the supporting wall extending downwardly from the upper edge and including a hook structure extending upwardly and forwardly therefrom;

wherein, upon removal of at least one of the merchandising trays from the merchandising tray arrangement supported on the shelf, the plurality of open slots are engaged with the hook structure of the group of merchandising trays supported on the shelf such that a second side edge of the base faces outwardly and away from the shelf to enable loading of the at least one merchandising tray.

* * * * *